US008800293B2

(12) United States Patent
Dierberger et al.

(10) Patent No.: US 8,800,293 B2
(45) Date of Patent: Aug. 12, 2014

(54) FLOATWELL PANEL ASSEMBLIES AND RELATED SYSTEMS

(75) Inventors: James A. Dierberger, Hebron, CT (US); Kevin W. Schlichting, Storrs, CT (US); Melvin Freling, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 1601 days.

(21) Appl. No.: 11/775,398

(22) Filed: Jul. 10, 2007

(65) Prior Publication Data

US 2009/0013695 A1 Jan. 15, 2009

(51) Int. Cl.
*F02C 1/00* (2006.01)
*F02G 3/00* (2006.01)

(52) U.S. Cl.
USPC ..... 60/754; 60/752; 60/753; 60/755; 60/756; 60/757; 60/758; 60/759; 60/760

(58) Field of Classification Search
USPC ..... 60/752–760
See application file for complete search history.

(56) References Cited

U.S. PATENT DOCUMENTS

| | | | | |
|---|---|---|---|---|
| 3,557,553 | A | 1/1971 | Schmitz | |
| 4,008,568 | A * | 2/1977 | Spears et al. | 60/796 |
| 4,441,324 | A * | 4/1984 | Abe et al. | 60/753 |
| 4,622,821 | A | 11/1986 | Madden | |
| 4,653,279 | A | 3/1987 | Reynolds | |
| 4,700,544 | A | 10/1987 | Fucci | |
| 5,129,231 | A | 7/1992 | Becker et al. | |
| 5,431,020 | A * | 7/1995 | Maghon | 60/753 |
| 5,623,827 | A | 4/1997 | Monty | |
| 6,973,419 | B1 | 12/2005 | Fortin et al. | |
| 7,146,815 | B2 * | 12/2006 | Burd | 60/752 |
| 7,793,503 | B2 * | 9/2010 | Grote et al. | 60/754 |
| 8,171,634 | B2 * | 5/2012 | Rudrapatna et al. | 29/890.1 |
| 2005/0249602 | A1 | 11/2005 | Freling et al. | |
| 2005/0262846 | A1 * | 12/2005 | Pidcock et al. | 60/752 |

FOREIGN PATENT DOCUMENTS

| | | |
|---|---|---|
| EP | 1500880 | 1/2005 |
| EP | 1533113 | 5/2005 |
| EP | 1748253 | 1/2007 |
| WO | 99/46540 | 9/1999 |

OTHER PUBLICATIONS

European Search Report dated Dec. 22, 2008.

* cited by examiner

*Primary Examiner* — Craig Kim
(74) *Attorney, Agent, or Firm* — Carlson, Gaskey & Olds P.C.

(57) ABSTRACT

Floatwall panel assemblies and related systems are provided. A floatwall panel assembly includes a panel formed of porous ceramic material, the porous ceramic material exhibiting a porosity gradient along at least one of a length, a width and a depth of the panel, the panel lacking a substrate, formed of a material other than porous ceramic material, for supporting the porous ceramic material.

9 Claims, 2 Drawing Sheets

FLOATWELL PANEL ASSEMBLIES AND RELATED SYSTEMS

BACKGROUND

1. Technical Field

This disclosure generally relates to combustion sections of gas turbine engines.

2. Description of the Related Art

Cooling of materials that are used to form combustion sections of gas turbine engines is accomplished using various techniques. By way of example, some materials that are used to line combustion sections incorporate film-cooling holes that are drilled through the materials at relatively shallow angles. Cooling air is provided to a backside of these materials, thereby allowing the air to travel through the film-cooling holes and cool a surface of the material that is closest to the combusting fuel and air mixture. Unfortunately, such a technique tends to be relatively inefficient in the use of cooling air. Additionally, the use of such a technique can still result in "hot spots" that can produce cracks in the material and material loss due to oxidation.

SUMMARY

Floatwall panel assemblies and related systems are provided. In this regard, an exemplary embodiment of a floatwall panel assembly comprises: a panel formed of porous ceramic material, the porous ceramic material exhibiting a porosity gradient along at least one of a length, a width and a depth of the panel, the panel lacking a substrate, formed of a material other than porous ceramic material, for supporting the porous ceramic material.

An exemplary embodiment of a combustion section of a gas turbine engine comprises: a floatwall panel assembly having a panel and a mount, the panel being formed of porous material, the porous material exhibiting a porosity gradient along at least one of a length, a width and a depth of the panel, the mount being configured to engage the panel and maintain the panel in a spaced relationship from a surface to which the panel is attached.

An exemplary embodiment of a gas turbine engine comprises: a combustion section having a combustor shell, a floatwall panel and a mount; the panel being attached to the combustor shell and spaced therefrom by the mount, the panel being formed of porous ceramic material, the porous ceramic material exhibiting a porosity gradient along at least one of a length, a width and a depth of the panel, the panel lacking a substrate.

An exemplary embodiment of a floatwall panel for a combustion section of a gas turbine engine comprises a porous material exhibiting a porosity gradient along at least one of a length, a width and a depth of the floatwall panel.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Floatwall panel assemblies and related systems are provided. In this regard, several embodiments will be described. In particular, several embodiments will be described that incorporate the use of floatwall panels that are used for lining combustion sections. Such a floatwall panel is formed of porous material, such as porous metal and/or ceramic, that can exhibit a porosity gradient. That is, porosity of the material can vary along one or more of a length, width and depth of the panel. In some embodiments, the porosity is engineered such that more transpiration cooling flow is provided at a portion of the panel that is expected to be exposed to higher temperatures within the combustion section. Thus, material with higher porosity can be provided in these locations, whereas other locations can be provided with material with lower porosity. This tends to provide a more efficient use of cooling airflow through the panel that can result in a requirement for less cooling air. As used herein, the term "porosity" refers to the number of pores per given volume and/or the size of pores.

Figure 1:
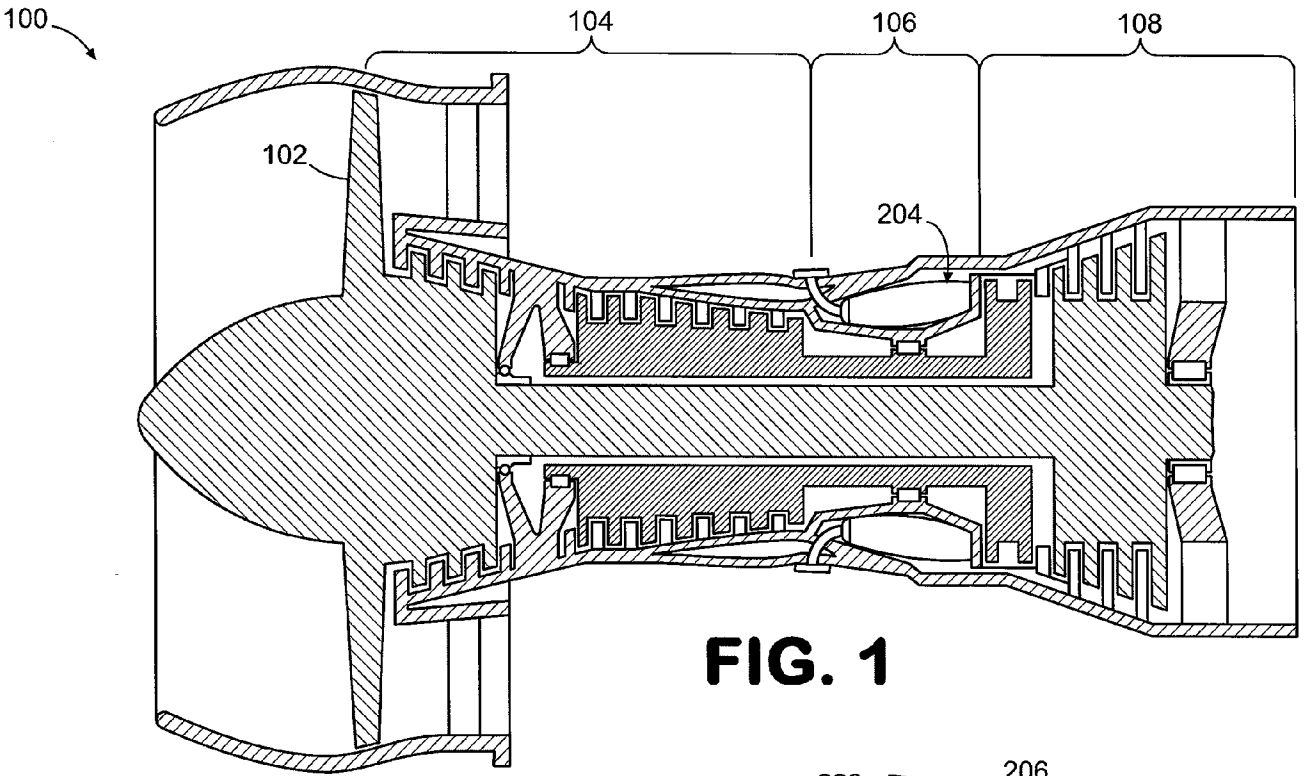
FIG. 1 is a schematic diagram depicting an embodiment of a gas turbine engine.

FIG. 1 is a schematic diagram of a gas turbine engine that incorporates an embodiment of a floatwall panel assembly. As shown in FIG. 1, engine 100 incorporates a fan 102, a compressor section 104, a combustion section 106 and a turbine section 108. Although gas turbine engine 100 is configured as a turbofan, there is no intention to limit the invention to use with turbofans as use with other types of gas turbine engines is contemplated. Additionally, the combustion section is a full-hoop annular combustion section in this embodiment; however, there is no intention to limit the invention to use with full-hoop annular combustion sections as use with other types of combustion sections is contemplated.

Figure 2:
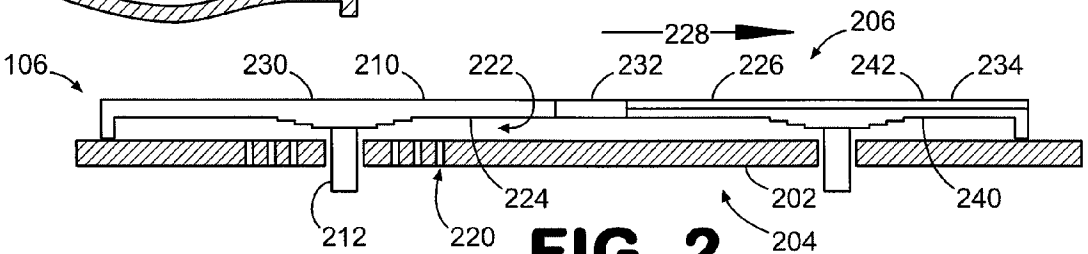
FIG. 2 is schematic diagram depicting a portion of a combustion section of FIG. 1.

A portion of combustion section 106 is depicted in FIG. 2. In particular, FIG. 2 schematically depicts a cross-section of a wall 202 of the combustor shell 204 of the combustion section, with a floatwall panel assembly 206 attached to the wall. The floatwall panel assembly includes a floatwall panel 210 and one or more mounts, e.g., mount 212, that are used to attach the floatwall panel to the wall 202. Various mounting techniques are described later with respect to FIGS. 3-6.

The combustor shell 204, which can be formed of various materials, such as metallic, ceramic and/or composite, incorporates impingement holes, e.g., hole 220, through which a flow of cooling air is provided. The cooling air exits the impingement holes and disperses within a gap 222 defined between an underside 224 (or combustor shell side) of the floatwall panel and wall 202 of the combustor shell. From the gap, the cooling air transpires through the floatwall panel from the underside to a hot section side 226 of the panel, where the air enters a gas flow path 228 of the combustion section. Notably, the floatwall panel exhibits a porosity that accommodates placement of the panel in the combustion section.

In this regard, temperature within a combustion section is typically location dependent. That is, some locations within a combustion section tend to experience hotter temperatures than do others. Those locations that tend to experience the hottest temperatures are generally referred to as hot spots.

In the embodiment of FIG. 2, floatwall panel 210 incorporates three regions, each of which exhibits a porosity that is different than that of an adjacent region. In this regard, the floatwall panel incorporates a first region 230, a second region 232 and a third region 234. Specifically, the first region 230 comprises an area of relatively uniform porosity across its length, width and depth. The second region also exhibits a relatively uniform porosity across its length, width and depth; however, this porosity is greater than that exhibited by the first region. Notably, the second region is positioned in an expected hot spot of the panel. Thus, the second region has been engineered to provide increased transpiration cooling, thereby mitigating the potentially adverse effects of the hot spot.

In contrast, the third region 234 incorporates two layers of disparate porosity. Specifically, a layer 240 located closest to the combustor shell exhibits a higher porosity along its length, width and depth than an adjacent layer 242, which is located closest to the gas flow path 228. By locating the material of the panel exhibiting lower porosity adjacent to the gas flow path, the pores of the material may be small enough to prevent blockage by particles that could be present in the gas flow path.

It should be noted that floatwall panels may be formed of various materials, such as porous metal, composites and/or ceramics. More information regarding porous metal and/or ceramics can be found in U.S. Published Patent Application 2005/0249602, which is incorporated by reference herein. In contrast, however, to some of the embodiments described in that application, floatwall panels may not involve the use of metal substrates.

As mentioned above, various techniques can be used for mounting a floatwall panel within a combustion section. Representative techniques are depicted schematically in FIGS. 3-6.

Figure 3:
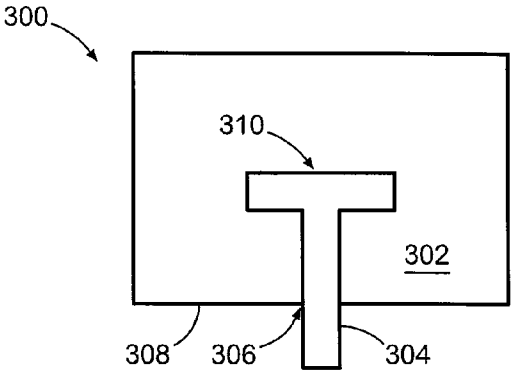
FIGS. 3-6 are schematic diagrams depicting representative embodiments of floatwall panel assembly attachments.

As shown in FIG. 3, a representative embodiment of a floatwall panel assembly attachment 300 includes a floatwall panel 302 and a mount 304. In this embodiment, a slot 306 is formed in a combustor shell side 308 of the panel that is configured to receive a distal end 310 of the mount. In this embodiment, the mount is configured as an elongate rail. Although such a rail and corresponding slot can be formed in various complementary shapes and sizes, the rail and slot of this embodiment are configured with a T-shape when viewed in cross-section.

In order to mount the floatwall panel to a wall of a combustion section, the rail is positioned to extend outwardly from the wall (not shown) and the panel is slid over the rail, thereby capturing the distal, protruding portion of the rail within the slot. Notably, in other embodiments, more than one slot and rail can be used per panel.

Figure 4:
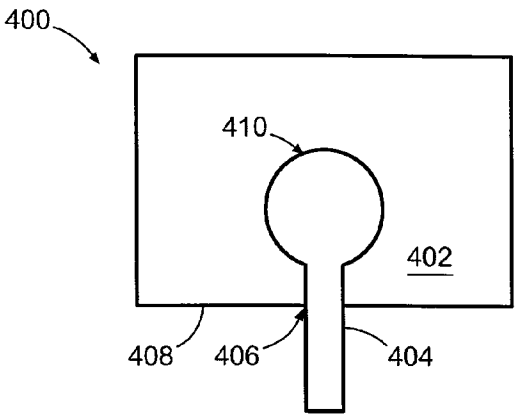

Another embodiment of a floatwall panel assembly attachment is depicted schematically in FIG. 4. In particular, floatwall panel assembly 400 includes a floatwall panel 402 and a mount 404. In this embodiment, a slot 406 is formed in a combustor shell side 408 of the panel that is configured to receive a bulbous distal end 410 of the mount. Thus, in this embodiment, the mount also is configured as an elongate rail with a profile that is generally complementary to that of the slot 406.

Figure 5:
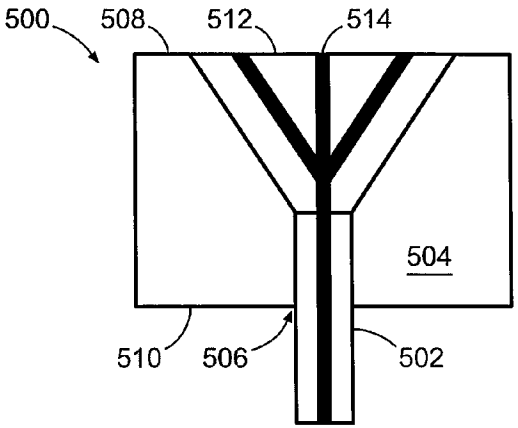

In contrast to the embodiments of FIGS. 3 and 4, the floatwall panel assembly attachment 500 of FIG. 5 incorporates a mount 502 that extends through the floatwall panel. Specifically, the panel 504 includes a mounting hole 506 that extends from a hot section side 508 to a combustor shell side 510 of the panel. The mounting hole is sized and shaped to receive a screw 512 that mounts the panel to the combustor shell. In this embodiment, screw 512 incorporates a means for cooling, which in this embodiment includes cooling channels, e.g., channel 514, through which cooling air is routed for cooling the screw. In other embodiments, various other cooling means can be used for cooling a mount such as one or more features that provide transpiration and/or impingement cooling. Notably, mounts can be formed of various materials, such as ceramics, nickel alloys, cobalt alloys, molybdenum alloys, niobium alloys, steel alloys and/or combinations thereof, for example.

Figure 6:
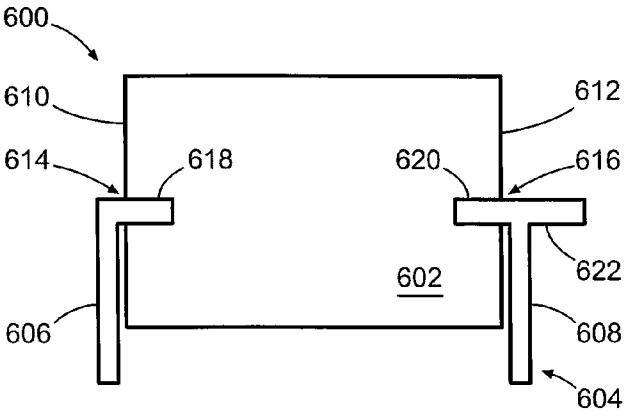

Another embodiment of a floatwall panel assembly attachment is depicted schematically in FIG. 6. As shown in FIG. 6, floatwall panel assembly 600 includes a floatwall panel 602 and a mount 604 that includes opposing rails 606, 608. In this embodiment, opposing side walls 610, 612 of the panel incorporate slots 614, 616 that are configured to receive corresponding portions 618, 620 of the rails. Clearly, when arranged to contiguously line the interior of a combustor shell, the rails can incorporate opposing extended portions, such as portions 620 and 622. Such a configuration can enable a rail to be positioned between and mount adjacent floatwall panels.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A combustion section of a gas turbine engine comprising:

a floatwall panel assembly having a panel and a mount, the panel being formed of porous material, the porous material exhibiting a porosity gradient along at least one of a length, a width and a depth of the panel, the mount being configured to engage the panel and maintain the panel in a spaced relationship from a surface to which the panel is attached wherein porosity means the number of pores per given volume and/or the size of pores whereby transpirational cooling of said panel occurs as coolant passes through said pores;

wherein the panel incorporates a first region, a second region, and a third region, the first, second, and third regions being arranged in series along a length of the panel, the length being parallel to a gas flow path, the first region being upstream of the second and third regions relative to the gas flow path;

wherein the first region comprises an area of relatively uniform porosity across its length, width and depth, and wherein the second region exhibits a relatively uniform porosity across its length, width and depth, the porosity of the second region being greater than the porosity exhibited by the first region; and wherein the third region incorporates a first layer and a second layer, the second layer located closer to the expected gas flow path than the first layer, and wherein the first layer exhibits a higher porosity along its length, width and depth than the second layer.

2. The combustion section of claim 1, wherein:

the combustion section further comprises a combustor shell; and the mount is configured to maintain the panel in a spaced relationship from a surface of the combustor shell.

3. The combustion section of claim 2, wherein:

the mount comprises a rail attached to the combustor shell; and the panel comprises a slot operative to receive the rail.

4. The combustion section of claim 3, wherein the slot is an elongate slot formed in a face of the panel.

5. The combustion section of claim 2, wherein:

the mount comprises a first rail and a second rail, each of which is attached to the combustor shell, the first rail being spaced from the second rail;

the panel comprises a first slot located in a first sidewall of the panel and a second slot located in a second sidewall of the panel; and the first slot is sized and shaped to receive the first rail and the second slot is sized and shaped to receive the second rail.

6. The combustion section of claim 5, wherein the first sidewall and the second sidewall oppose each other.

7. The combustion section of claim 2, wherein:

the mount is a screw; and the panel comprises a through-hole extending from a hot section face to a combustor shell face of the panel, the through-hole being sized and shaped to receive the screw.

8. The combustion section of claim 7, further comprising means for cooling the screw.

9. The combustion section of claim 1, wherein the second region is positioned in an expected hot spot of the panel.

* * * * *